US005606953A

United States Patent [19]

Drummer et al.

[11] Patent Number: 5,606,953

[45] Date of Patent: Mar. 4, 1997

[54] FUEL INJECTION DEVICE FOR INTERNAL COMBUSTION ENGINES

[75] Inventors: Eugen Drummer; Maximilian Kronberger, both of Steyr; Helmut Sattmann, Eferding; Herbert Strahberger, Gallneukirchen; Gerhard Weisz, Neuhofen/Krems, all of Austria

[73] Assignee: Robert Bosch GmbH, Stuttgart, Germany

[21] Appl. No.: 392,885

[22] PCT Filed: Jun. 18, 1994

[86] PCT No.: PCT/DE94/00693

§ 371 Date: Mar. 1, 1995

§ 102(e) Date: Mar. 1, 1995

[87] PCT Pub. No.: WO95/02123

PCT Pub. Date: Jan. 19, 1995

[30] Foreign Application Priority Data

Jul. 7, 1993 [DE] Germany ..... 43 22 546.2

[51] Int. Cl.[6] ..... F02M 37/04

[52] U.S. Cl. ..... 123/506; 123/458; 251/282

[58] Field of Search ..... 123/458, 506, 123/509, 508, 507; 251/129.16, 282, 129.21

[56] References Cited

U.S. PATENT DOCUMENTS

| | | | |
|---|---|---|---|
| Re. 34,261 | 5/1993 | Sule | 251/129.16 |
| 4,119,294 | 10/1978 | Schnorrenberg | 251/282 |
| 4,550,744 | 11/1985 | Igashira | 251/282 |
| 4,579,145 | 4/1986 | Leiber | 251/129.16 |
| 4,615,323 | 10/1986 | LeBlanc | 123/509 |
| 4,653,723 | 3/1987 | Rizk | 251/282 |
| 4,678,160 | 7/1987 | Yamada | 251/129.16 |
| 4,785,787 | 11/1988 | Riszk | 123/458 |
| 4,832,312 | 5/1989 | Linder | 251/282 |
| 5,007,401 | 4/1991 | Grohn | 123/509 |
| 5,123,626 | 6/1992 | Schlagmuller | 251/129.16 |
| 5,125,383 | 6/1992 | Meier | 123/509 |
| 5,125,807 | 6/1992 | Kohler | 123/458 |
| 5,267,721 | 12/1993 | Stroh | 251/282 |
| 5,273,017 | 12/1993 | Braun | 123/449 |
| 5,277,163 | 1/1994 | Ohishi | 123/458 |
| 5,427,073 | 6/1995 | Timms | 251/129.16 |

FOREIGN PATENT DOCUMENTS

| | | |
|---|---|---|
| 0315564 | 5/1989 | European Pat. Off. . |
| 3728817 | 3/1988 | Germany . |
| 2213205 | 8/1989 | United Kingdom . |

*Primary Examiner*—Carl S. Miller

*Attorney, Agent, or Firm*—Edwin E. Greigg; Ronald E. Greigg

[57] ABSTRACT

A fuel injection device with a pump plunger which is driven in reciprocation and a working space which is enclosed by the pump plunger, and is connected to an injection valve connected directly to the pump housing. To control the fuel injection quantity and the injection instant, a solenoid valve is provided which is arranged in a fuel passage that is connected to the pump working space and serves for the filling and/or relief of the pump working space. To reduce the volumes subjected to the high pressure, the fuel passage is arranged in such a way that the fuel passage intersects the cylinder bore which accommodates the pump working space, and the solenoid valve is arranged at the entry of this passage.

22 Claims, 3 Drawing Sheets

FUEL INJECTION DEVICE FOR INTERNAL COMBUSTION ENGINES

PRIOR ART

The invention is based on a fuel injection device of an internal combustion engine. In a fuel injection device of this kind, known from DE-A1-37 31 240, the pump plunger is driven in reciprocation by means of a camshaft of an internal combustion engine. As a housing for the fuel injection device with the pump plunger, the pump cylinder and the injection valve an integrally formed housing is provided and this is connected directly to the cylinder head for the associated internal combustion engine. In this arrangement, the housing part bearing the exchangeable injection nozzle, together with the spring space of the injection valve, is arranged obliquely to the axis of the pump plunger. From the pump working space, a fuel passage leads directly to a solenoid valve, by means of which the phase of high-pressure generation in the pump working space is controlled. In this configuration, the space which is supplied with fuel under injection pressure during the pump plunger delivery stroke is additionally enlarged by the fuel passage leading to the solenoid valve and by an adjoining valve antechamber which is bounded by the valve seat of the solenoid valve in the closed position of the latter. This relatively large dead space reduces the efficiency and the accuracy of injection of the fuel injection device. At the same time, moreover, a relatively large installation space is required for the fuel injection device.

ADVANTAGES OF THE INVENTION

In contrast, the fuel injection device according to the invention has the advantage that the high-pressure volume is considerably reduced and, at the same time, that a fuel injection device of more compact design is achieved.

The invention has an advantage that the volume of the fuel passage between the pump cylinder and the valve seat can, in addition, be kept very small. If the valve is designed as a sliding valve with a piston slide this volume is reduced further. A continuous connection between the fuel passage and the pump working space results in only Slight enlargements of the cylinder space which is provided for the pump working space. The provisions set forth herein provide reliable guidance of the valve member of the solenoid valve while at the same time keeping the high-pressure dead space within the fuel passage small. One configuration set forth advantageously results in an economical manufacture by virtue of the fact that the valve member of the solenoid valve is coupled non-positively to the armature of the solenoid valve. Exact centering of the solenoid-valve body and the pump body is thus rendered unnecessary. It is furthermore advantageously achieved that overshooting of the magnet armature upon opening of the solenoid valve is avoided. A further development is advantageously achieved in that smaller fluctuations in operating times occur because the disturbing forces caused by pressure fluctuations in the fuel feed, particularly during opening, are smaller. The shape of the piston-like part of the valve member here results in a high degree of freedom from reaction due to fuel pressures acting on the valve member. Another configuration provides an easy-to-service and easy-to-assemble construction with good accessibility to the solenoid valve. Tolerances involved in the fitting of the fuel injection device on the cylinder head of the internal combustion engine are easily compensated for. Another configuration provides a compact construction in which it is possible to provide a smaller return spring for the pump plunger since an additional restoring force in the direction of the drive of the pump plunger during the delivery stroke of the pump plunger is achieved. In particular, a higher contact force is obtained at the end of the pump plunger delivery stroke.

DRAWING

Two exemplary embodiments of the invention are depicted in the drawing and explained in detail in the description which follows.

FIG. 1 shows a longitudinal section through the pump cylinder and the injection valve of the fuel injection device of a first exemplary embodiment, FIG. 2 shows a section perpendicular to the plane of the illustration in FIG. 1 along the line II—II, FIG. 3 shows a partial section through the fuel injection device in the longitudinal direction of the pump plunger and in a plane rotated through 90° relative to the illustration in FIG. 1 and taken along the line III—III in FIG. 2, and FIG. 4 shows a longitudinal section similar to that in FIG. 1 with a modified configuration of the electrically controlled valve.

DESCRIPTION OF THE EXEMPLARY EMBODIMENT

Figure 1:
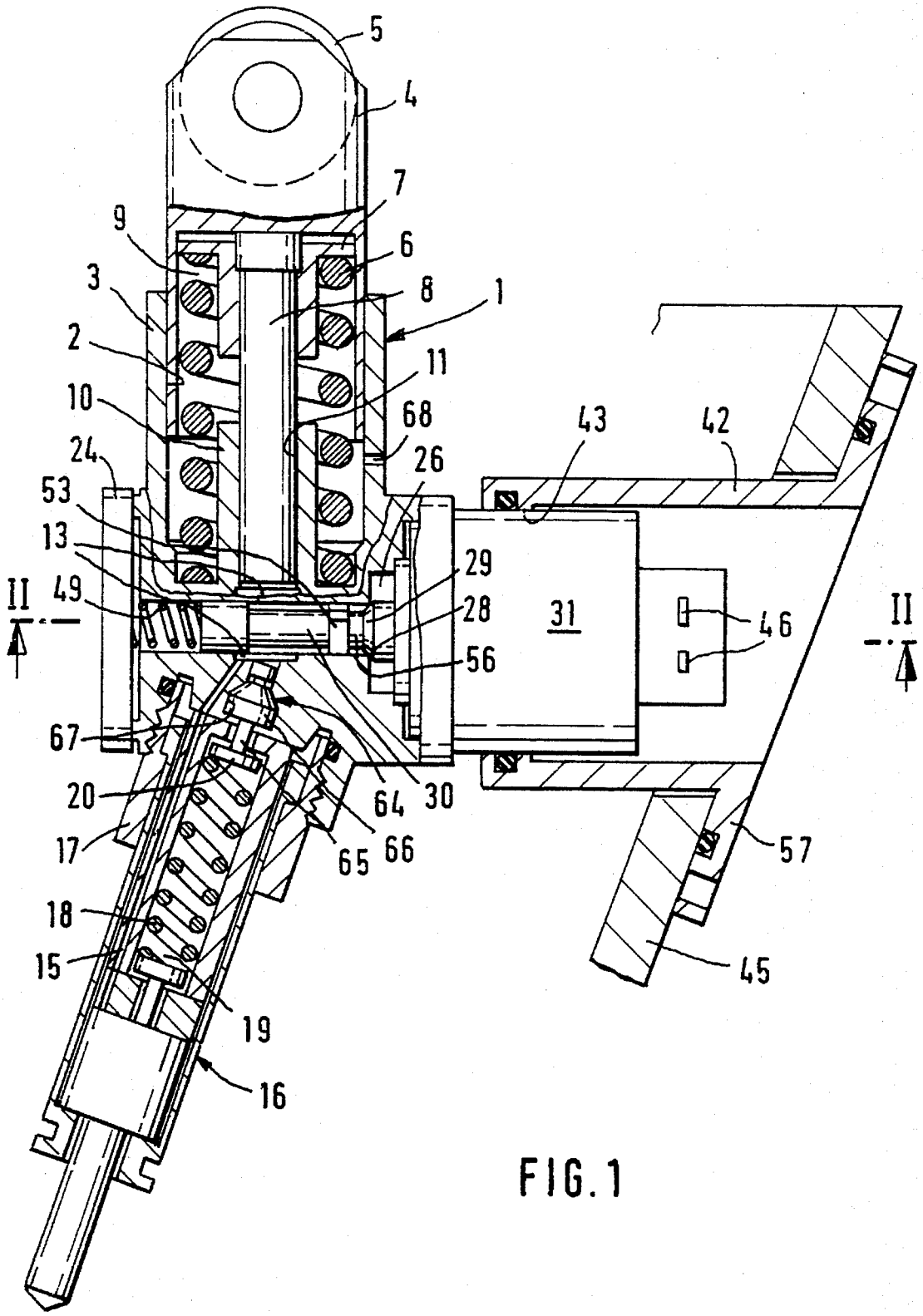
Figure 3:
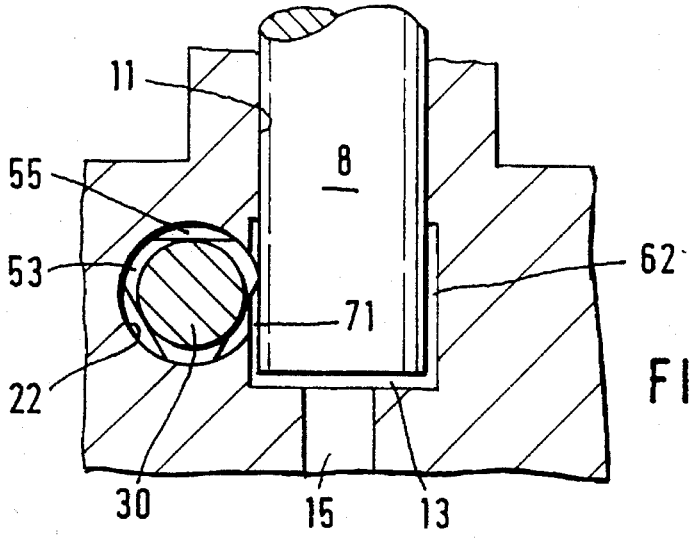

In the section shown in FIG. 1, a pump housing i is shown sectioned, the said pump housing having a cylindrical stub 3 with a tappet bore 2 into which there plunges from its open end, with a sliding action, a roller tappet 4 which at the outer end carries a roller 5 on which a rocker lever (not shown specifically) actuated by a camshaft of the internal combustion engine engages. The roller tappet encloses in its interior a compression spring 6 supported, at one end, against the bottom of the stub opening and, at the other end, via a spring plate 7, against the roller tappet 4. Held between the spring plate and the roller tappet is a pump plunger 8 which plunges into a cylinder bore 11 of a pump cylinder projecting in the form of a stub into the spring space 9 enclosed by the roller tappet 4 and the stub 3. There it delimits with its end a pump working space 13, which is also shown in FIG. 3 but in more detail. From the latter, a delivery line 15 leads on in the pump housing to an injection valve which is fastened by its housing 16 to the pump housing using a union nut 17. In the injection valve housing, the delivery line leads on to the nozzle space (not shown specifically) of the injection valve, which is of known design. The valve needle of the injection valve is loaded in the closing direction by an injection valve closing spring 18 which is accommodated in a spring space 19 of the injection valve housing and is supported, at the other end, against an adjustable spring plate 20.

Figure 2:
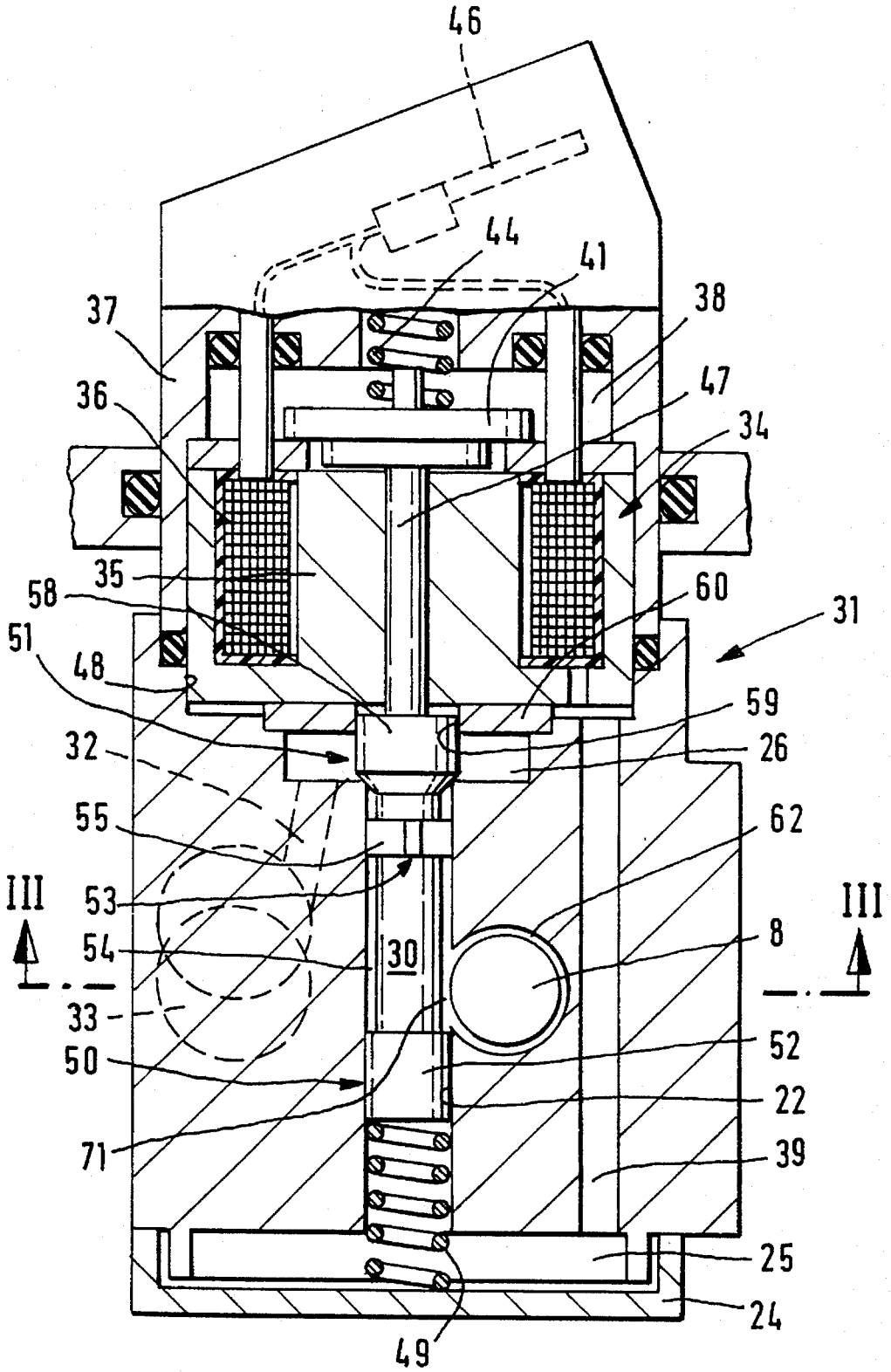

As can be seen from the sections shown in FIG. 2 and FIG. 3, the cylinder bore 11 is intersected by a fuel passage 22 in such a way that, in a partial area of the fuel passage, part of the circumferential wall of the latter is open to the pump cylinder within the area of intersection with the latter. In this arrangement, the fuel passage advantageously runs transversely to the axis of the cylinder bore 11, the axis of the fuel passage 22 preferably lying in a plane radial with respect to the axis of the cylinder bore 11. The fuel passage is designed as a transverse through hole through the pump housing 1, as can be seen from FIGS. 1 and 2, one exit of the fuel passage being closed by a closure part, here, for example, a cap 24 which simultaneously encloses a balance space 25 into which the fuel passage 22 emerges. At the other end, the fuel passage opens into a spill space 26 which is formed as a recess or a blind hole of relatively large diameter in the pump housing 1. The transition between the fuel passage and the spill space 26 is designed as a valve seat 28, which is conical and interacts with a corresponding conical sealing surface 29 on a valve member 30 of a solenoid valve 31. The spill space is furthermore part of the fuel passage. Via a branch conduit 32, the spill space 26 is connected to a fuel inlet bore 33 in the pump housing and is supplied via this hole with low-pressure fuel by a fuel feed pump. However, the branch conduit 32 and the fuel feed can also be used to pump back excess fuel not delivered by the pump plunger.

The blind hole forming the spill space 26 merges into a hole with a larger diameter to form a receiving opening 48 into which a magnet core 35 with a magnet coil 36 of an electromagnet 34 of the solenoid valve 31 is inserted and held there by a magnet housing 37 surrounding both of them. Enclosed between the magnet housing 37 and the magnet core 35 with the magnet coil 36 is a second balance space 38, which is connected directly, by balance holes 39 in the pump housing, to the balance space 25 at the other end of the fuel passage 22.

Arranged in the second balance space 38 is an armature disc 41 which interacts with the end of the magnet core 35 in a known manner. The armature disc is pressed in the direction of the magnet core by a return spring 44 supported against the magnet housing 37. Adjoining the armature disc 41 in the solenoid valve 31 is an armature tappet 47 which is passed through an axial hole in the magnet core 35 and, at its other end, comes to rest against the valve member 30. The valve member is acted upon at its end remote from the armature tappet by a compression spring 49, which is supported against the cap 24 and thus holds the valve member in non-positive engagement with the armature tappet. Under the action of the two springs 49 and 41, the valve member is moved in the opening direction when the magnet is not excited, and the fuel passage 22 is thus opened towards the spill space 26.

Cable connections lead through the second balance space 38 and pass leak tightly through the magnet housing 37 to the outside, where the connections for the magnet coils 36 are located. The magnet housing is of cylindrical design and is held in a slidably displaceable manner in a cup-shaped insert 42 which, at its end pointing towards the fuel injection device, has a passage opening 43 for guiding the cylindrical magnet housing and is there provided with sealing means and, at its other end, the end remote from the injection device, has an external flange 57 which comes to rest on adjoining parts of a cylinder-head wall 45 of the internal combustion engine with a sealing means inserted between them and is fastened there and its part facing towards the fuel injection device is passed through a corresponding opening in this cylinder-head wall. The contact-making connections 46 for the magnet coil of the solenoid valve are thus accommodated in a protected manner within the cup-shaped insert and are nevertheless accessible from outside. The cup-shaped insert is fastened to the cylinder-head wall by means of releasable fastening elements and, in addition, can be displaced before being fixed in order to compensate for installation and alignment tolerances. The interior of the cylinder head is thus sealed off at the outside by means of this cup-shaped insert.

The valve member 30 of the solenoid valve 31 comprises a first part 50, which projects into the fuel passage 22, and of a second part 51, which projects into the spill space 26. Towards the balance space 25, the first part 50 ends with a piston 52 which separates the balance space from an annular groove 54 which lies between this piston 52 and a guide piston 53 and which is acted upon by the injection pressure. The guide piston has passage openings 55 which connect the annular groove 54 to an annular space 56 situated between the guide piston 53 and the sealing surface 29. The conical sealing surface 29 is located on a cylindrical part 58 of enlarged diameter of the second part 51 of the valve member against which the armature tappet 47 comes to rest. The cylindrical part 58 furthermore plunges into a guide hole 59 in a washer 60 which is arranged between the spill space 26 and the magnet core 35, closing off the spill space 26. When the electromagnet is not excited, the cylindrical part 58 thus comes to rest under the action of the spring 49 against the end of the magnet core, which is at the same time the stop which determines the travel of the valve member. This stop and thus the opening cross-section of the valve can be adjusted by means of the thickness of the washer.

The annular groove 54 on the valve member is situated in the region of that part of the fuel passage 22 which intersects the cylinder bore 11 and is thus connected continuously to the cylinder bore 11. To safeguard the connection to the pump working space 13, the cylinder bore 11 has in its lower part a diameter enlargement 62, as can be seen from FIG. 3, so that when the pump plunger has plunged all the way in in the region of the upper extreme position of the pump plunger or the end of its delivery stroke, the pump working space 13 always remains connected to the annular groove 54 via this diameter enlargement. The diameter enlargement can be designed as an annular groove or annular recess or is a longitudinal groove which likewise leads to the end 64 of the cylinder bore and is situated in the region of the overlap of the fuel passage with the cylinder bore. The connection between the cylinder bore and the fuel passage 32 can also be first established with the machining of this recess, for which purpose the connection can, in the final analysis, also be achieved by means of piercing with the aid of an erosion method, which is used, in particular also for machining sharp-edged transitions in cross-section, with the result that, in geometrical terms, there is no overlap of the cross-sections of the bore of the fuel passage 22 and the recess or cylinder bore 11. However, the connection produced in this way is equivalent to an overlap.

As a further development, the pump working space can also be connected to an accumulator valve 64. For this purpose, the spring plate 20 is connected by a tappet 65 to a piston part 66 which is displaceable in leaktight fashion in a hole 67 and is acted upon by the pressure of the pump working space counter to the force of the injection valve spring. During the delivery stroke of the pump plunger, some of the fuel delivered can be taken up by means of a yielding movement of the piston part 66 in order to reduce the pressure build-up at the beginning of delivery of the fuel injection device. At the same time, the removal of fuel facilitates the closure of the solenoid valve, which, while the valve is still open, receives a force component in the opening direction at the beginning of the pressure build-up in the pump working space.

With the valve described above, there remains between the pump working space 13 and the spill space 26 only a very small space subjected to the high fuel injection pressure, this space consisting essentially of the volume of the annular groove 54 and the annular space 56. In this way, a higher hydraulic efficiency and more exact control of the fuel injection quantity and of the fuel injection instant are obtained since a loss of operating time for the filling of spaces subjected to high pressure and their relief is reduced.

The double guidance of the valve member, on the one hand by the piston 52 and on the other hand by the guide piston 53 or, in addition, the guidance of the cylindrical part 58 in the guide hole 59 in the washer 60 result in reliable setting of the sealing surface 29 on the valve seat 28 and accurate and reliable operation of the solenoid valve, the dynamic behaviour of which is furthermore improved by its mounting between two springs 49 and 41, since the tendency to overshoot is thereby reduced. Hydraulically, the valve member 30 is pressure-balanced from both sides by way of the balance space 25, the second balance space 38 and the spill space 26. These balance spaces are supplied with fuel by leakage losses, e.g. between the cylindrical part 58 and the washer 60. By virtue of the fact that the cylindrical part 58 is larger in diameter than the diameter of the fuel passage, the valve member is acted upon by the high pressure in the opening direction in addition to the force of the spring 46 as soon as it is opened in the course of the delivery stroke of the pump plunger, and this leads to a short opening time.

Figure 4:
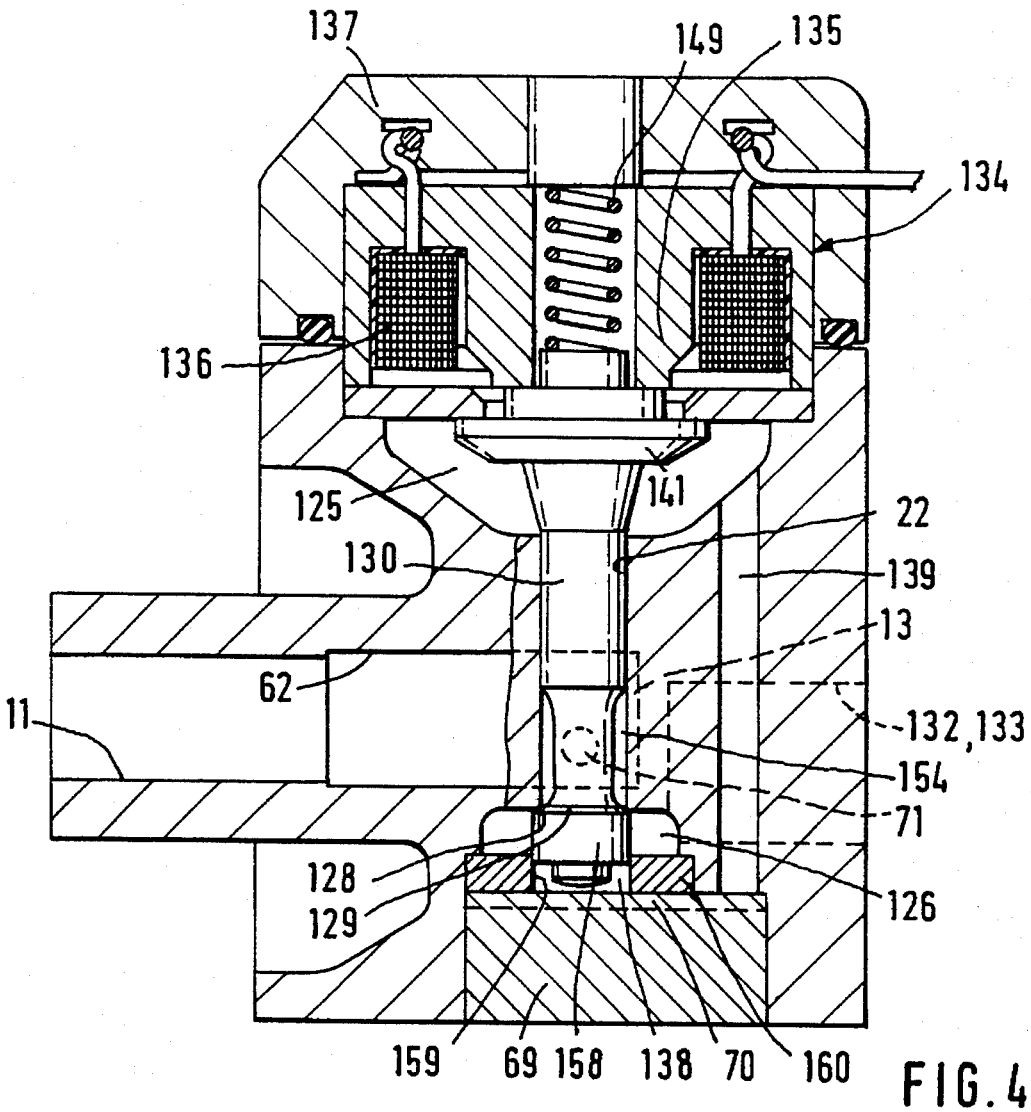

An alternative embodiment, which represents a simplification relative to the embodiment of FIGS. 1 to 3, is shown in FIG. 4. As a modification to the embodiment in accordance with FIG. 1, the electromagnet has here been arranged on that end of the valve member remote from the sealing surface. As in FIG. 1, the fuel passage 22 is formed in the housing of the injection device as a through hole through the pump housing I and is connected to the cylinder bore 11 and the pump working space 13 in the same way. At one end, the fuel passage 22 opens into a spill space 126 which is connected via a fuel inlet bore 133 to a low-pressure fuel space for the purpose of supplying the pump working space 10 with fuel and relieving it. On the side opposite the exit of the fuel passage 22, the spill space 126 is bounded by a washer 160, which is held in the pump housing by a closure part 69 which closes off the pump housing leaktightly from the outside. The washer has a guide hole 159 which is connected via a groove 70 in the end of the closure part 69 to a balance hole 139 in the pump housing and, via the said hole, to a first balance space 125, into which the fuel passage 22 opens at its other end.

The valve member 130 of this exemplary embodiment is designed as a piston which is arranged so as to slide in leaktight fashion in the fuel passage 22 and has an annular groove 154 similar to the annular groove 54 of FIG. 1, which is continuously connected to the pump working space 13 and the cylinder bore 11 by a connecting cross-section 71 formed by penetration of the fuel passage and of the pump cylinder or by a diameter enlargement 62 of the same or by erosive production of this connection. The annular groove 154 is bounded by a cylindrical part 158 of the valve member, which part projects into the spill space 126, is larger in diameter than the diameter of the fuel passage and of the piston part, guided in the latter, of the valve member and, at its end facing towards the annular groove 154, has a conical sealing surface 129 which interacts with a likewise conical valve seat 128 at the transition from the fuel passage to the spill space 126. The cylindrical part 158 of the valve member furthermore plunges at its end into the guide hole 159 and thus separates the spill space 126 from a second balance space 138 enclosed by the cylindrical part 158 in the guide hole. This space is, as explained, connected to the first balance space 125 by the balance hole 139.

That part of the valve member 130 which projects into the first balance space 125 bears an armature 141 which interacts with the magnet core 135 of the electromagnet 134 now arranged on this side. The magnet core together with the magnet coil 136 is surrounded by a magnet housing 137 which closes off the housing together with the first balance space 125 from the outside. Inserted into a hole in the magnet core is a return spring 149 in the form of a compression spring which presses the valve member 130 in the direction of its open position and counter to the direction in which the valve member is moved into its closed position by means of the armature 141 when the electromagnet 134 is excited. This provides an economical solution with a doubly guided valve member, this in turn having the advantage that the sealing surface can settle with a good seal on the valve seat 128 in the closed state, with the valve member being guided well, and good closing characteristics at acceptable expenditure on production are thus achieved. The opening travel of the valve member 130 is determined by its end-face contact with the closure part and can be adjusted by means of the latter.

Instead of a seat valve with a valve member 30, 130 guided in the manner described, a pressure-balanced piston slide can also be used while maintaining minimum dead spaces subjected to the high pressure, this piston slide then having a piston which slides leaktightly in the fuel passage 22 and controls the connection of a drain and feed hole to the annular groove 54 or pump cylinder instead of the guide piston 53 and the sealing surface interacting with a valve seat.

As an additional development, the spring space 9 in the stub 3 is completely enclosed by the roller tappet 4 and is only relievable via a restriction opening 68. However, this restriction hole is closed in the course of the delivery stroke of the pump plunger by that part of the roller tappet 4 which plunges into the stub 3, with the result that, towards the end of the pump plunger delivery stroke, a restoring pressure which assists the operation of the return spring 6 is built up in a now closed spring space 9 by the cam drive of the fuel injection pump. In particular, this prevents the tendency of the roller tappet or rocker lever to lift off from the driving cam towards the end of the delivery stroke since a higher restoring force acts in this region. However, the maximum pressure between the roller and the cam is not thereby increased owing to the fact that the characteristic of the cam lift curve of the drive cam becomes flatter towards the end of the stroke. By means of the dimensioning of the restriction and of the travel at which the restriction is closed, it is possible to achieve an optimization here of the restoring forces in order to improve the driving behaviour of the cam drive.

We claim:

1. A fuel injection device for internal combustion engines, with a pump plunger (8) which in a cylinder bore (11) delimits a pump working space (12) and is driven in reciprocation, and with a delivery line (15) which connects the pump working space (13) to an injection valve (16), an injection valve member which is opened counter to a closing force (18) under an injection pressure of the fuel pumped out of the pump working space (13) via the delivery line (15), and with fuel passage (22, 26, 32, 33) leading from the pump working space (13) via an electrically controlled valve (31) to a fuel reservoir space at a lower pressure than the injection pressure, a portion of the fuel passage (22) on a part of its circumferential wall is connected to an interspace (62) formed between this part of the cylinder bore (11) and the lateral surface of the pump plunger (8), said interspace is permanently connected to the pump working space and the entry into that part of the fuel passage (22) which is connected to the pump cylinder is controlled by the valve member (30) of the electrically controlled valve (31).

2. A fuel injection device according to claim 1, in which the portion of the fuel passage intersects the interspace.

3. A fuel injection device according to claim 1, in which the connection between the portion of the fuel passage and the interspace is produced by erosive removal of material.

4. A fuel injection device according to claim 1, in which a seat valve member is provided as the valve closing member, having a sealing surface (29) which interacts with a valve seat (28) arranged at the exit of the fuel passage (22) into an enlarged space (26).

5. A fuel injection device according to claim 4, in which the valve closing member (30) projects by means of a guide part (52, 53) into the fuel passage (22) as far as the region of the connection of the latter to the cylinder bore (11) and partially fills the fuel passage.

6. A fuel injection device according to claim 1, in which that part of the fuel passage (22) which is connected to the pump cylinder is designed as a guide hole for a valve member, designed as a piston slide, of the electrically controlled valve (31).

7. A fuel injection device according to claim 1, in which the interspace is formed by a recess.

8. A fuel injection device according to claim 1, in which the interspace is formed by an annular recess (62).

9. A fuel injection device according to claim 1, in which the housing (16) of the injection valve directly adjoins the pump housing (1) which accommodates the cylinder bore (11) and the fuel passage (22).

10. A fuel injection device according to claim 5, in which the guide part has a piston (52) which delimits an annular groove, connected continuously to the cylinder bore (11), on the guide part (52) of the valve member, which annular groove is delimited, at another end, by that part of the valve member (30) which bears the sealing surface (29).

11. A fuel injection device according to claim 10, in which the annular groove (54) is delimited towards the sealing surface of the valve closing member by a guide piston (53) having passages, and an annular space (56) is provided at the valve closing member (30) between the guide piston (53) and the sealing surface (29).

12. A fuel injection device according to claim 6, in which the piston slide has an annular space which is connected continuously to the cylinder bore (11) and Is bounded by a control edge by means of which an onward-leading part of the fuel passage is controlled.

13. A fuel injection device according to claim 1, in which the valve member is pressed against an armature (47, 41), provided as the actuating device of the valve member, of an electromagnet (34) by a spring (49) acting in the opening direction of the valve closing member, and the armature (47, 41) is acted upon by a return spring (44) acting in the direction of the valve member and moves the valve member into the closed position when the electromagnet is excited.

14. A fuel injection device according to claim 13, in which the force resulting from the spring (49, 44) engaging on the armature (41, 47) and on the valve member (30) acts in the opening direction of the valve member, the valve closing member being acted upon counter to this direction, in the closing direction, under the action of the magnetic force of the electromagnet.

15. A fuel injection device according to claim 5, in which the valve member (130) can be moved against a stop (69) by a spring (149) acting in the direction of the open position of the valve member and is connected to an armature (141) of an electromagnet (134) which is provided as the actuating device for the valve (30) of the electrically controlled valve (31), by means of which armature the valve member can be moved into the closed position counter to the force of the spring when the electromagnet is excited.

16. A fuel injection device according to claim 10, in which the sealing surface (29) of the valve member (30, 130) is arranged on one end of a cylindrical part of the valve member, the said part being larger in diameter than the guide part and projecting into the enlarged space (36, 126), which part plunges with its end remote from the sealing surface into a guide hole (59, 159), separating the space (38, 138) enclosed by it in the latter from the enlarged space (26, 126).

17. A fuel injection device according to claim 16, in which as a balance space (38, 138) the enclosed space is pressure-balanced.

18. A fuel injection device according to claim 16, in which the electromagnet (34) of the electrically controlled valve is inserted from outside into a receiving opening (48) on the pump housing and, with its magnet core (35), which carries the magnet coil (36), delimits the enlarged space (26), at the same time clamping in a washer (60) which has the guide hole (59) in the center, and the bottom of the magnet core (35) serves as the stroke stop for the valve member, and acting on the valve member is an armature tappet (47) which is passed through the magnet core (35) and at its other end merges into an armature disc (41).

19. A fuel injection device according to claim 18, in which that end of the valve member (30) which faces away from the electromagnet (34) adjoins a first balance space (25), which is connected to a second balance space (38) surrounding the electromagnet on that side of the washer (60) which faces away from the enlarged space (26).

20. A fuel injection device according to claim 17, in which at one end, the valve member (13) projects out of the fuel passage into a first balance space (125) and is there connected to the armature (141) of the electromagnet (134), and the guide hole (159) is arranged in a disc (160) which adjoins the enlarged space (126) and is clamped in the housing of the fuel injection device by a closure part (69), and the closure part serves as a stroke stop for the valve member (130), and in that the space enclosed in the guide hole (160) by the valve member is a second balance space (138), which is hydraulically connected to the first balance space (125).

21. A fuel injection device according to claim 1, in which the partial area of the fuel passage (22) runs transversely to the axis of the cylinder bore (11).

22. A fuel injection device according to claim 15, in which the fuel passage (22) and the valve member (30) lie with their axes in a plane radial with respect to the axis of the cylinder bore (11), and that part of the driving part of the electrically controlled valve (31) which carries the electrical connections (46) is mounted in such a way in a cup-shaped insert (42) that it projects into the interior of the cup-shaped part (42), which has an external flange (44) by means of which it is fastened to the edges of an opening in the housing of the internal combustion engine with, in particular, leak-tight closure of the housing of the internal combustion engine.

* * * * *